US008459456B2

(12) United States Patent
Donnelly

(10) Patent No.: US 8,459,456 B2
(45) Date of Patent: Jun. 11, 2013

(54) SANITARY CANDLE COVERS FOR CAKES AND CUPCAKES

(76) Inventor: Brian A. Donnelly, East Northport, NY (US)

( * ) Notice: Subject to any disclaimer, the term of this patent is extended or adjusted under 35 U.S.C. 154(b) by 0 days.

(21) Appl. No.: 13/430,194

(22) Filed: Mar. 26, 2012

(65) Prior Publication Data

US 2012/0247996 A1 Oct. 4, 2012

Related U.S. Application Data

(60) Provisional application No. 61/468,628, filed on Mar. 29, 2011, provisional application No. 61/475,302, filed on Apr. 14, 2011.

(51) Int. Cl.
*B65D 73/00* (2006.01)

(52) U.S. Cl.
USPC ..... 206/457; 431/295

(58) Field of Classification Search
USPC ..... 206/457, 459.5, 499, 223, 508, 519, 206/521
See application file for complete search history.

(56) References Cited

U.S. PATENT DOCUMENTS

| | | | | |
|---|---|---|---|---|
| 1,125,855 A | | 1/1915 | Mapes | |
| 1,511,004 A | | 10/1924 | Pooch | |
| 1,778,597 A | | 10/1930 | Herzog | |
| 1,879,477 A | | 9/1932 | Powell | |
| 1,982,723 A | | 12/1934 | Bantleon | |
| 2,170,040 A | * | 8/1939 | Stuart | 220/574 |
| 2,303,540 A | | 6/1940 | Montgomery | |
| 2,316,342 A | * | 4/1943 | Krieg | 431/125 |
| 2,347,041 A | * | 4/1944 | Filsinger | 312/204 |
| 2,393,767 A | | 1/1946 | Gould | |
| 2,406,777 A | | 9/1946 | Koretzky | |
| 2,468,505 A | * | 4/1949 | McNeill | 431/126 |
| D157,043 S | | 1/1950 | Gruber | |
| 2,617,350 A | | 11/1952 | Shol | |
| 2,758,458 A | * | 8/1956 | Carlson | 312/280 |
| D183,456 S | | 9/1958 | Henderson | |
| 2,852,054 A | | 9/1958 | Motely | |
| 2,924,330 A | * | 2/1960 | Ballard | 206/493 |
| 2,960,770 A | | 11/1960 | Valenta | |
| 2,997,788 A | | 8/1961 | Gilbert | |
| 3,076,577 A | | 2/1963 | Craig | |

(Continued)

FOREIGN PATENT DOCUMENTS

| | | | |
|---|---|---|---|
| FR | 2592782 | A1 | 7/1987 |
| WO | 2009111821 | A1 | 9/2009 |

*Primary Examiner* — J. Gregory Pickett
*Assistant Examiner* — Ernesto Grano
(74) *Attorney, Agent, or Firm* — Alfred M. Walker

(57) ABSTRACT

A sanitary cake cover with a removable candle deck, which protects the contents of the cake from contamination during blowing out of celebratory candles. The transparent cake covers with a removable candle deck, which does not pierce the cake being decorated by lighted celebratory candles. The cake cover can be used without the candle deck. The sanitary cake cover is impervious to assault by normal airborne contaminants, such as dust and dirt as well from contaminated expelled breath during the act of blowing out candles. A separate removable candle deck which can be attached to or nestled securely atop the cover is removable to enable the container to be used for other food items without the obstruction of candle recesses. The flat top of either a round, rectangular or other shaped cover has a peripheral top ridge forming a flat central recess of dimensions to fit the flat candle deck.

9 Claims, 10 Drawing Sheets

U.S. PATENT DOCUMENTS

| | | | | | |
|---|---|---|---|---|---|
| 3,204,359 | A | | 9/1965 | Kurokawa | |
| 3,736,214 | A | * | 5/1973 | McBirnie | 28/7 |
| 3,819,455 | A | | 6/1974 | MacKendrick | |
| 3,996,675 | A | * | 12/1976 | Placek | 434/196 |
| 4,206,845 | A | | 6/1980 | Christian | |
| 4,219,119 | A | * | 8/1980 | Zefran | 206/457 |
| 4,359,159 | A | | 11/1982 | Pollard | |
| 4,385,554 | A | | 5/1983 | Daenen | |
| 4,663,506 | A | * | 5/1987 | Bowen et al. | 219/730 |
| 4,721,455 | A | * | 1/1988 | Barfus | 431/295 |
| 4,741,452 | A | * | 5/1988 | Holzkopf | 220/783 |
| 4,884,966 | A | | 12/1989 | Wexler | |
| 4,938,688 | A | * | 7/1990 | Wexler | 431/295 |
| 5,096,274 | A | | 3/1992 | Fuschetto | |
| D333,410 | S | | 2/1993 | Panzarello | |
| 5,582,478 | A | | 12/1996 | Ambrosino | |
| 5,673,802 | A | | 10/1997 | Valentino | |
| D446,083 | S | | 8/2001 | Marsh | |
| D455,850 | S | | 4/2002 | Haskins | |
| 6,607,377 | B2 | | 8/2003 | Latzel | |
| D490,276 | S | | 5/2004 | Pereira | |
| 6,736,632 | B2 | | 5/2004 | Wolter | |
| D499,645 | S | * | 12/2004 | Edwards | D9/429 |
| 6,892,883 | B1 | * | 5/2005 | Brumfield et al. | 206/459.5 |
| D584,926 | S | | 1/2009 | Ethier | |
| D633,654 | S | * | 3/2011 | Berkete | D28/79 |
| 8,056,751 | B2 | * | 11/2011 | Vovan | 220/300 |
| 8,307,982 | B1 | * | 11/2012 | Vovan | 206/467 |
| 2004/0224271 | A1 | | 11/2004 | Langsam | |
| 2004/0244604 | A1 | * | 12/2004 | Slagter | 99/485 |
| 2005/0056162 | A1 | | 3/2005 | Milligan | |
| 2005/0087459 | A1 | | 4/2005 | Slagter | |
| 2006/0115781 | A1 | | 6/2006 | Greiner | |
| 2006/0130677 | A1 | | 6/2006 | Chou | |
| 2007/0048680 | A1 | | 3/2007 | Cartledge | |
| 2008/0272019 | A1 | * | 11/2008 | Miller | 206/457 |
| 2009/0181335 | A1 | | 7/2009 | Tropeano | |

* cited by examiner

Fig. 6
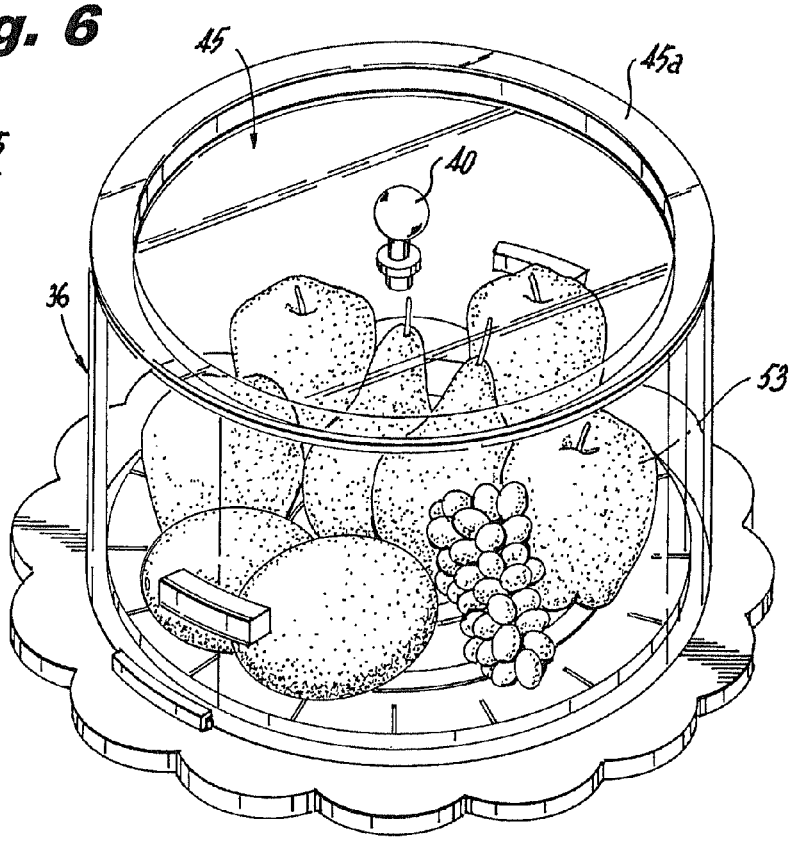
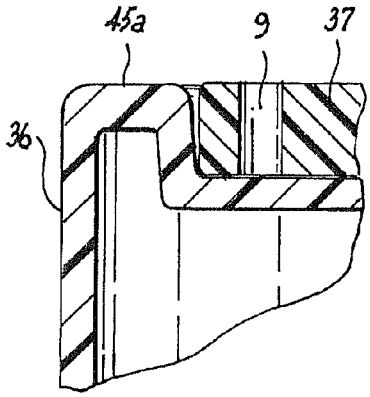
Fig. 7
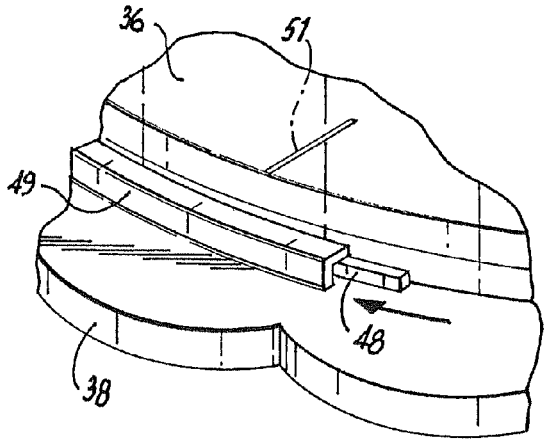
Fig. 8

Fig. 9
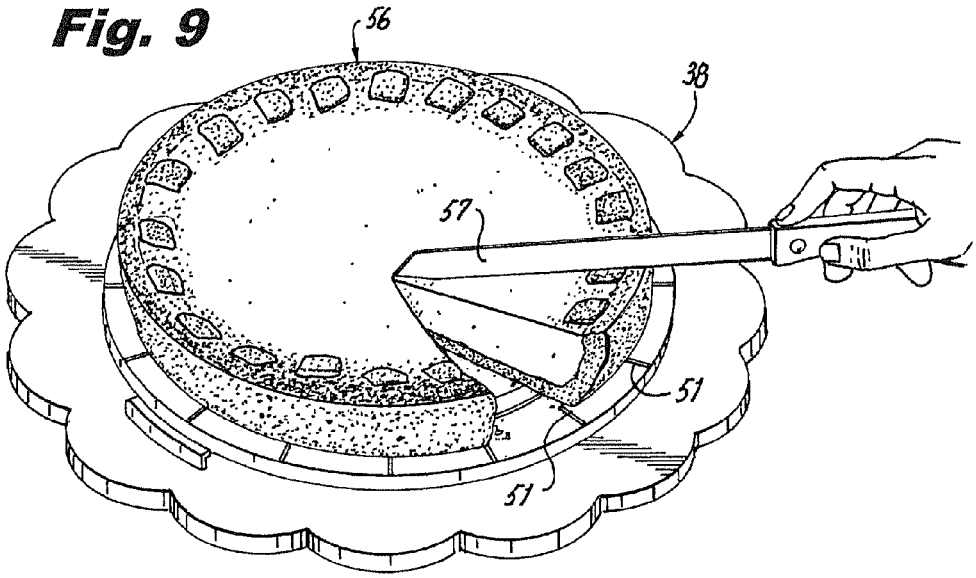
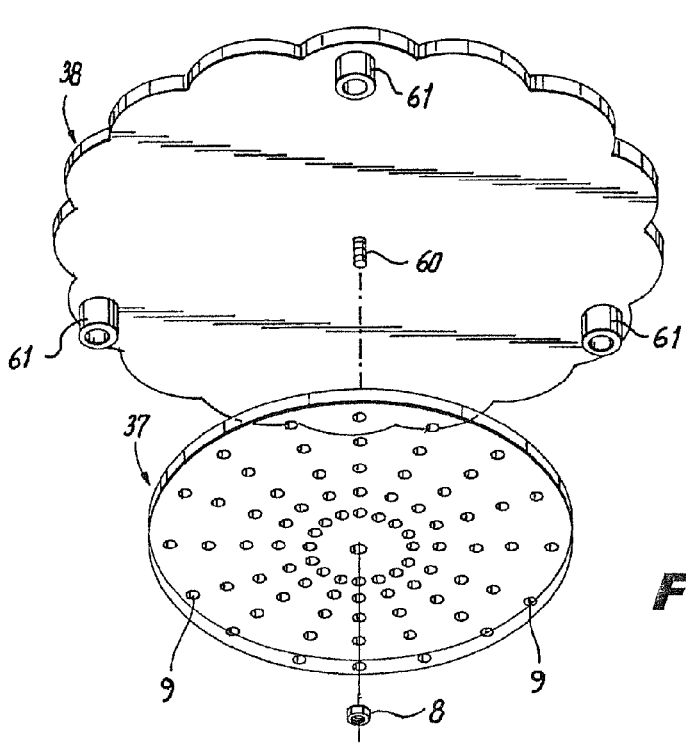
Fig. 10

SANITARY CANDLE COVERS FOR CAKES AND CUPCAKES

RELATED APPLICATIONS

This application is based upon provisional applications 61/468,628 filed Mar. 29, 2011 and 61/475,302 filed Apr. 14, 2011, and claims priority therefore under 35 U.S.C. §119(e). These applications are incorporated by reference herein.

FIELD OF THE INVENTION

The present invention relates to transparent cake covers with removable candle decks which do not pierce the cake being decorated by candles.

BACKGROUND OF THE INVENTION

The age-old problem with birthdays and other occasions involving cakes with candles atop is one of sanitation relating to the task of blowing out the candles. When the celebrant blows out the candles, the liquid wash which emanates from his or her mouth descends upon the cake possibly infecting it with a deluge of germs, fluids, and perhaps other debris. The tradition of substituting multiple cupcakes for the cake at such celebrations is becoming more popular. They are often grouped in a cluster with one candle on each cupcake wherein the celebrant proceeds to blow out the candles with similar unsanitary exposure.

This sanitary problem with candle-blowing atop cakes has been explored by several patents in the prior art. Carlson, with his birthday cake cover with base, of U.S. Pat. No. 2,758,458, deals with the problem by providing a circular cake cover with slightly domed top surface having a pattern of recesses for candles and a central knob. The cover is securely latched onto the base.

The birthday cake cover and candle holder of Barfus (U.S. Pat. No. 4,721,455) is supported by a stake into the cake and covers the top surface only, thereby offering little protection to the side of the cake. The cake protector of MacKendrick (U.S. Pat. No. 3,819,455) includes a central dome shaped section with integral candle holders and a lower flange which rests on the top surface of the cake. The sides of the cake are protected by a collar with inwardly directed upper flange and an outwardly directed lower flange. In operation, the collar is lowered onto the central dome wherein the upper flange rests on the lower flange of the dome section, while the lower collar flange rests on, or is close to, the supporting surface.

The cake cover of Mc Birnie (U.S. Pat. No. 3,736,214) includes several parts. Four stakes with flat tops are forced into the top surface of the cake. They support a rigid transparent disk slightly larger than the cake diameter. A transparent flexible sheet is then draped over the disk, a second transparent disk of similar size is then placed atop the sheet. Separate candles in holders with flat bottoms are then placed atop the top disk. If the sheet is a woven fabric, the protection of the side of the cake is in some jeopardy. The fragility of separate candles in holders is a safety concern.

Wexler's cake cover and candle holder (U.S. Pat. No. 4,938,688) uses a thin vacuum formed transparent plastic cover with sloping sides and flat top with integral candle indentations to cover a cake. Wexler's protective cake cover and candle holder (U.S. Pat. No. 4,884,966) also is based on the use of a vacuum formed plastic cover; but it now also uses tubular standoffs on the cake icing separating the top cover surface from the cake top. Besides having candle indentations, the top surface also can use these indentations as cutting guides by marking the top of the cake.

The prior art does not reveal a protective transparent cover for a cup cake with a candle holder atop. Also, the prior art does not reveal a transparent cake cover with a removable candle deck to permit dual-use as a fruit, cheese, or other food container with an unobstructed view, while at the same time, avoiding piercing of any part of the cake when used with a cake and a candle deck.

OBJECTS OF THE INVENTION

It is therefore an object of the present invention to provide a sanitary cake cover with a removable candle deck, which protects the contents of the cake from contamination during blowing out of celebratory lighted candles.

It is also an object of the present invention to provide a transparent cake cover with a removable candle deck, which does not pierce the cake being decorated by celebratory lighted candles.

It is also an object of the present invention to provide a cake cover which has a removable candle deck, wherein the cake cover can be used without the candle deck.

Other objects which become apparent from the following description of the present invention.

SUMMARY OF THE INVENTION

In keeping with these objects and others which may become apparent, the present invention is a sanitary cake cover which is a dual-use container, which houses a cake of a geometric shape, such as round, rectangular or fanciful (i.e. football, shamrock, cartoon character or organizational logo) shape in a transparent housing impervious to assault by normal airborne contaminants, such as dust and dirt as well as that from contaminated, microbe infiltrated, expelled breath, during the act of blowing out candles. A separate removable candle deck, which can be attached to or nestled securely atop the cover, is used to enable the container to be used for display and storage of other food items without the obstruction of candle recesses. The flat top of either a round, rectangular or other shaped cover has a peripheral top ridge forming a flat central recess of dimensions to fit the flat candle deck. The candle deck can be optionally stored underneath the fiat base when not in use.

In another embodiment, a transparent cover with a cylindrical side and a hemispherical domed top is used as a cup cake cover. The center of the dome has a hole accepting a bottom extension of a decorative ferrule with a candle recess in its center. This offers equivalent protection for a cupcake as the sanitary cake cover offers to a cake during a candle-blowing ceremony.

The cake cover embodiment is available with several variations. First, the transparent cylindrical, rectangular or other shaped cover can just be supported by a flat base. Alternatively, a round cylindrical cover can optionally have engagement members which mate with and lock into recesses on the base. The base can optionally be enhanced with indicia which extend beyond the circumference of a cake, as a guide to cutting standard sized slices. The bottom of the base can have a plurality of support legs (such as three) raising it off a support surface and providing space for storage of the candle deck when not in use. A central knob can be attached through a hole in the cover or by other fastener means, with or without the candle deck in use. This knob is also preferably used to attach the candle deck to the cover.

The candle deck can also be used unattached to the cover, with or without a central knob. In this variation, the flat depressed surface within the peripheral edge ridge of the cover top need not have a central hole to receive a screw thread or other fastener, thus resulting in a more appealing unobstructed view for dual-use service as a food item container.

BRIEF DESCRIPTION OF THE DRAWINGS

The present invention can best be understood in connection with the accompanying drawings. It is noted that the invention is not limited to the precise embodiments shown in drawings, in which:

FIG. 6 is a perspective view of the sanitary cover of FIG. 4 housing fruit as in a dual-use configuration without a candle deck;

FIG. 7 is a close-up detail view in cross section of the top edge of the cover and the candle deck taken along view line "7-7" of FIG. 4, when viewed in the direction of the arrows depicted therein;

FIG. 8 is a close-up detail perspective view of the respective lock members of the cover and the base as shown in the dashed circle line "8" of FIG. 4;

FIG. 9 is a perspective view of a knife guided by the indicia on the base being used to cut a slice of cheesecake;

FIG. 10 is a bottom perspective view of the base of the sanitary cover of FIG. 4, showing three legs and the method of storing the candle deck;

DETAILED DESCRIPTION OF THE INVENTION

Figure 1:
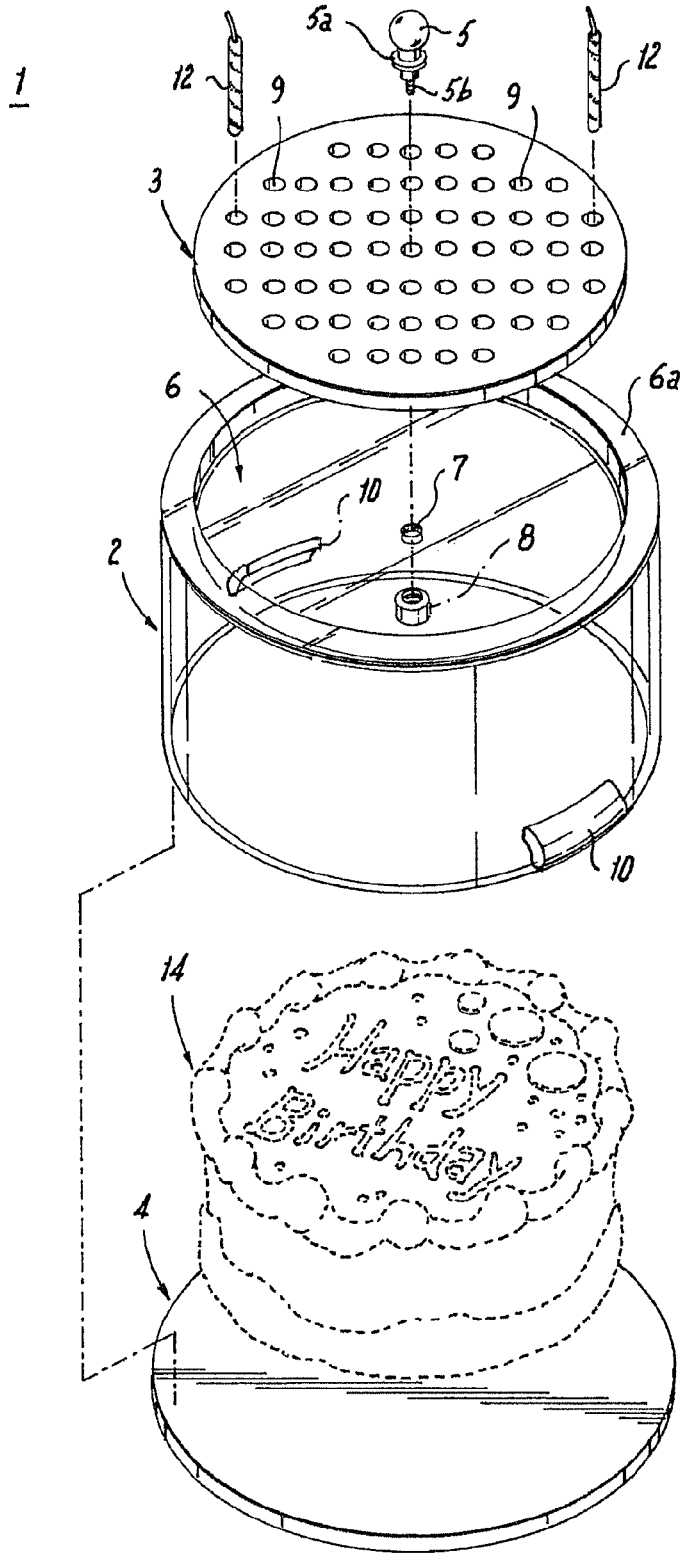
FIG. 1 is an exploded perspective view of the first embodiment for the sanitary cake cover of this invention with a candle deck, attachment knob, cover, round birthday cake and plain base.
Figure 2:
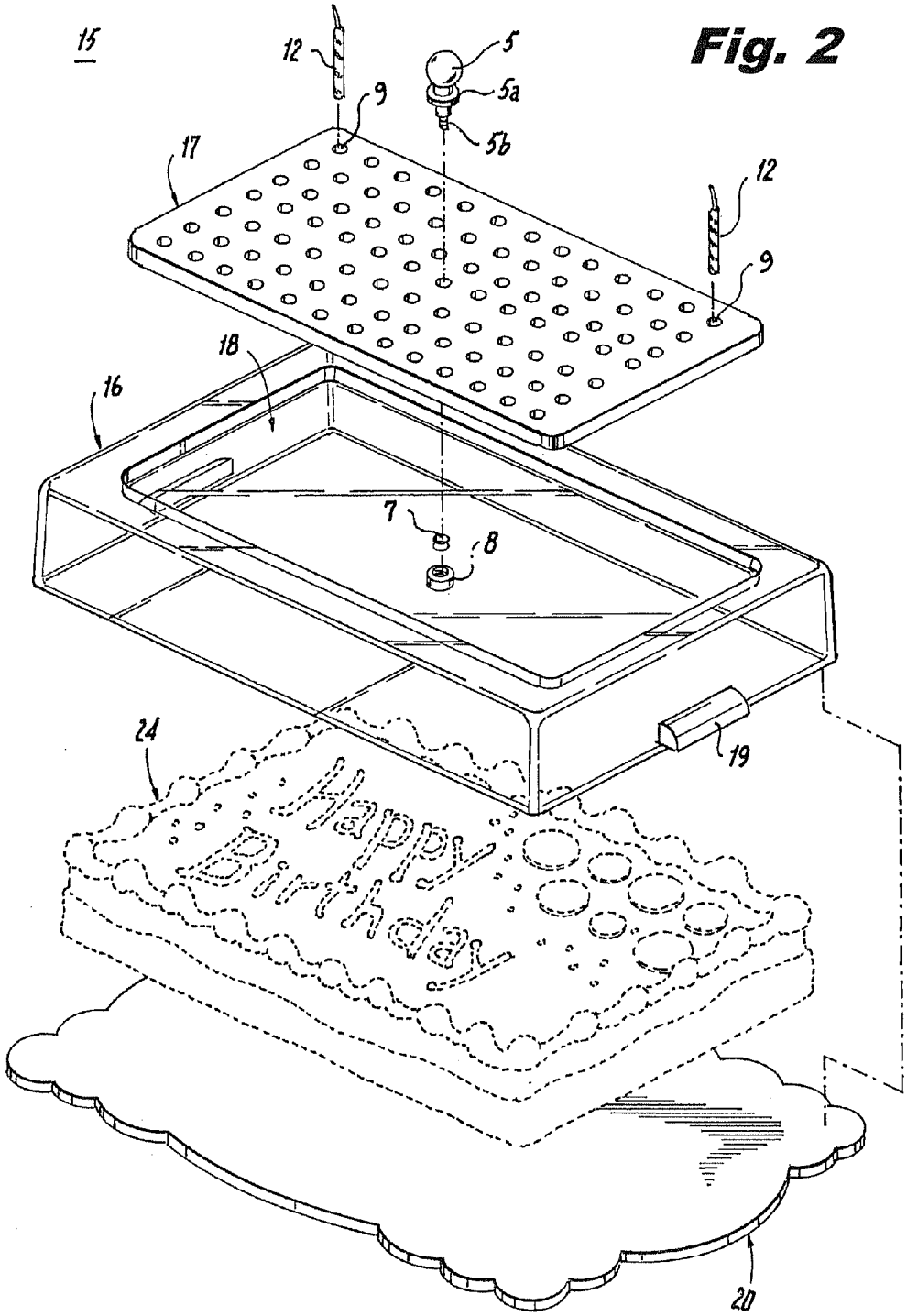
FIG. 2 is an exploded perspective view of the second embodiment for the sanitary cake cover of this invention for a rectangular cake, such as a "sheet cake", showing the equivalent features as in FIG. 1.

FIGS. 1 and 2 each show a transparent sanitary cake cover assembly (designated by reference numerals 1 or 15) of this invention with a removable candle deck for a round cake and for a rectangular cake respectively.

In FIG. 1, cover 2 is a round transparent cover with top edge peripheral ridge 6*a* and flat depressed region 6. Cover 2 has optional lift handles 10 and a fastener means, such as a central hole 7 to accept the screw extension 5*b* below flange 5*a* of knob 5, which fits through central hole 7 in removable candle deck 3 and attaches deck 3 to cover 2 via a fastener, such as nut 8 on the underside of depressed region 6. Round cake 14 is supported by plain base 4, and candles 12 populate some of grid holes 9 in candle deck 3.

FIG. 2 shows transparent sanitary cake cover assembly 15 for rectangular cake 24 which is supported by plain base 20. A rectangular cover 16 with optional handles 19, central hole 7, and depressed region 18, which supports rectangular removable candle deck 17 therein, when candle deck 17 is surrounded by upwardly extending peripheral ridge 18*a* of rectangular cover 16.

While FIGS. 1 and 2 show round and rectangular shapes for the transparent cover and cake therein, it is understood that other shapes for the transparent sanitary cake cover and cake itself may be used, for example, including other geometric shapes (i.e. triangles or ovals, etc.), or fanciful shapes (i.e. football, shamrock, cartoon character or organizational logo).

Figure 3:
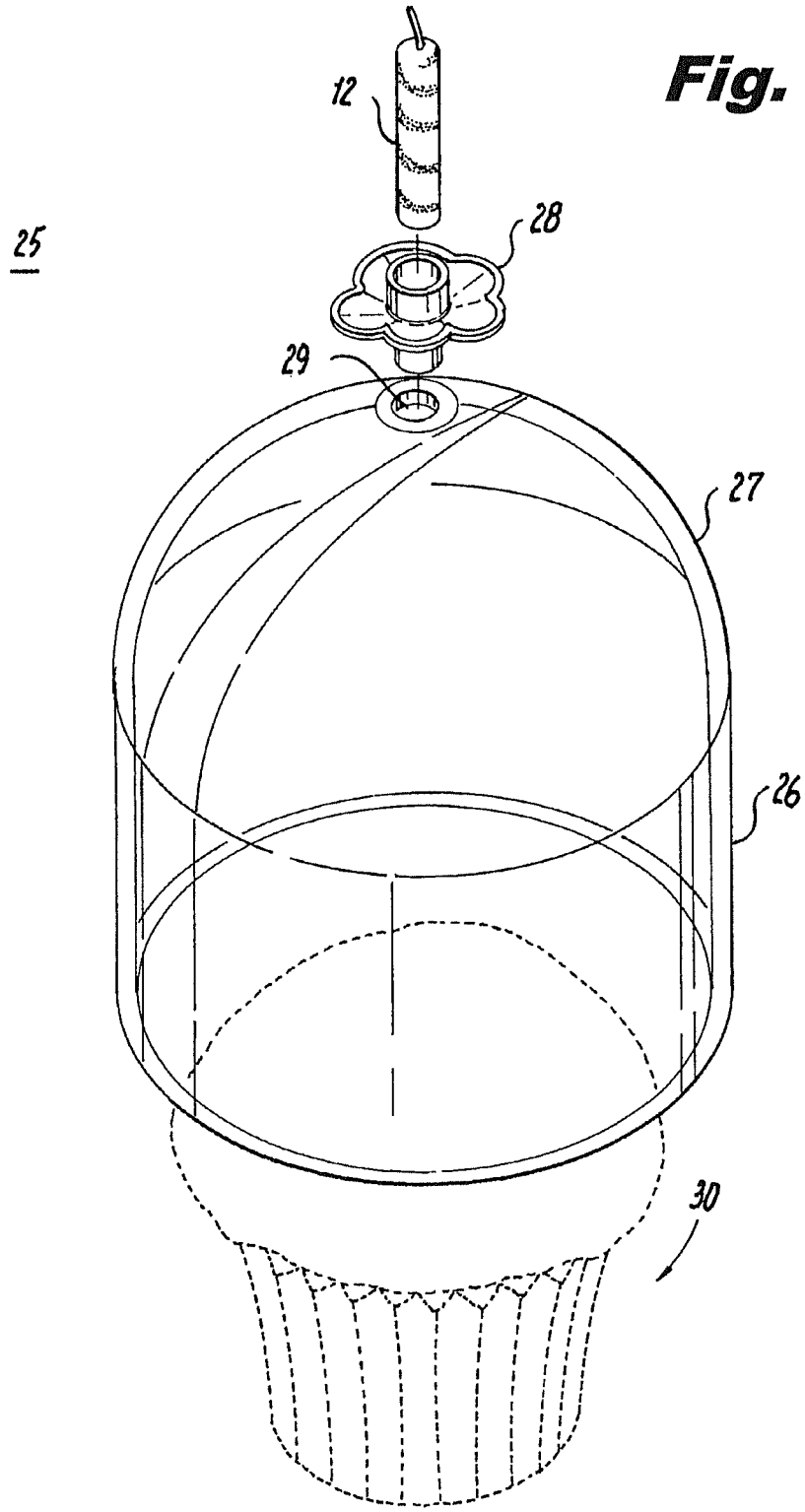
FIG. 3 is an exploded perspective view of a third embodiment for a domed sanitary candle cover of this invention for a cup cake.

FIG. 3 shows the alternate embodiment for sanitary cover 25 for cup cake 30. It has a transparent cylindrical side 26 with dome top 27. Hole 29 accepts ferrule 28 snugly which has a recess for candle 12 on top.

Figure 4:
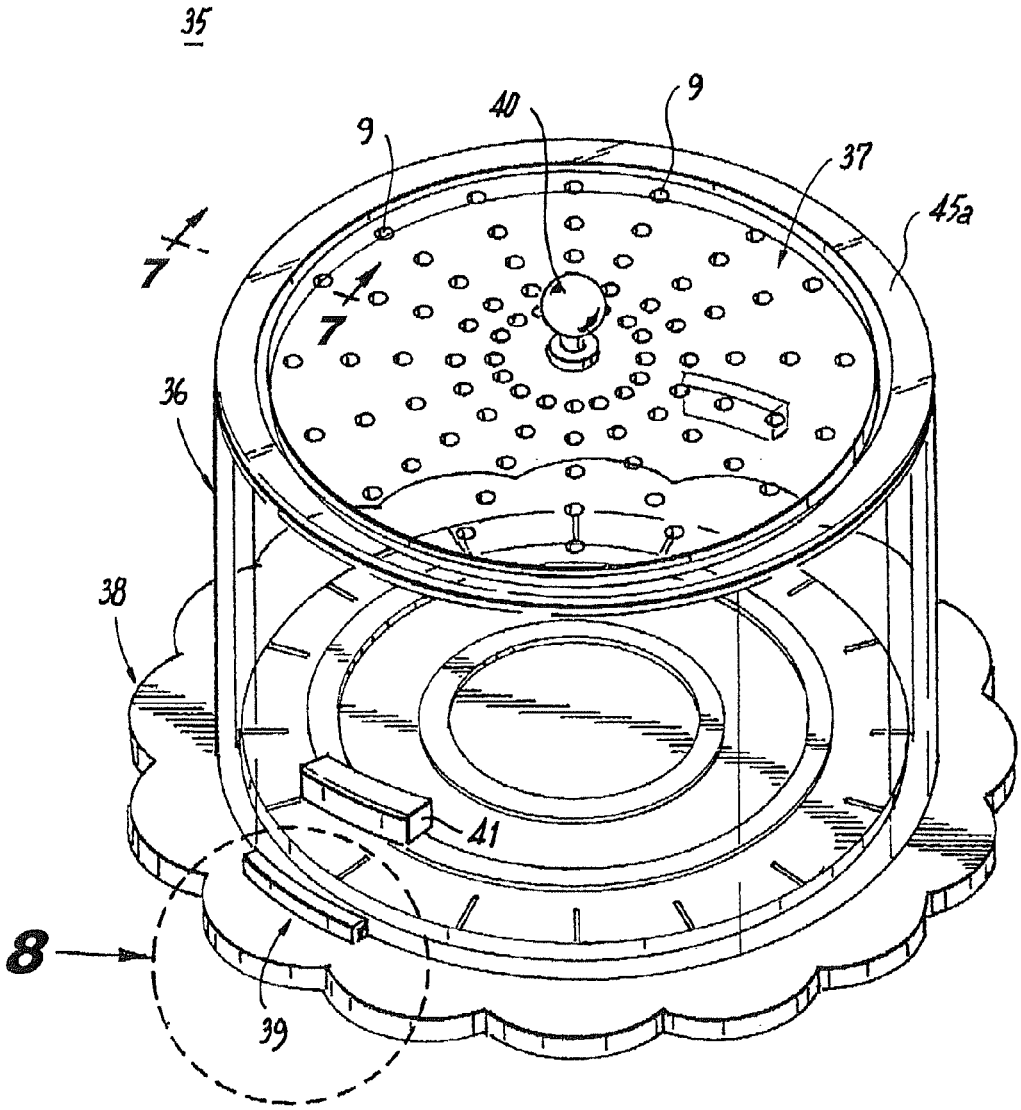
FIG. 4 is a perspective view of a fourth embodiment for a sanitary cover with an optional decorative starburst designed candle deck for a round cake; wherein the cover locks into the base.

FIG. 4 shows several alternate embodiment variations for a sanitary cake cover assembly 35, which differs from sanitary cover 1, which include sanitary cover 36. Cover 36 locks into base 38 via two engaged locks 39. Handles 41 can be used for lifting in lieu of knob 40. Removable candle deck 37 with a starburst pattern, or other array pattern, of candle holes 9 is attached to the top recessed region of cover 36 by fasteners, such as knob 40.

FIGS. 5-11 show more details of the sanitary cake cover assembly 35.

Figure 5:
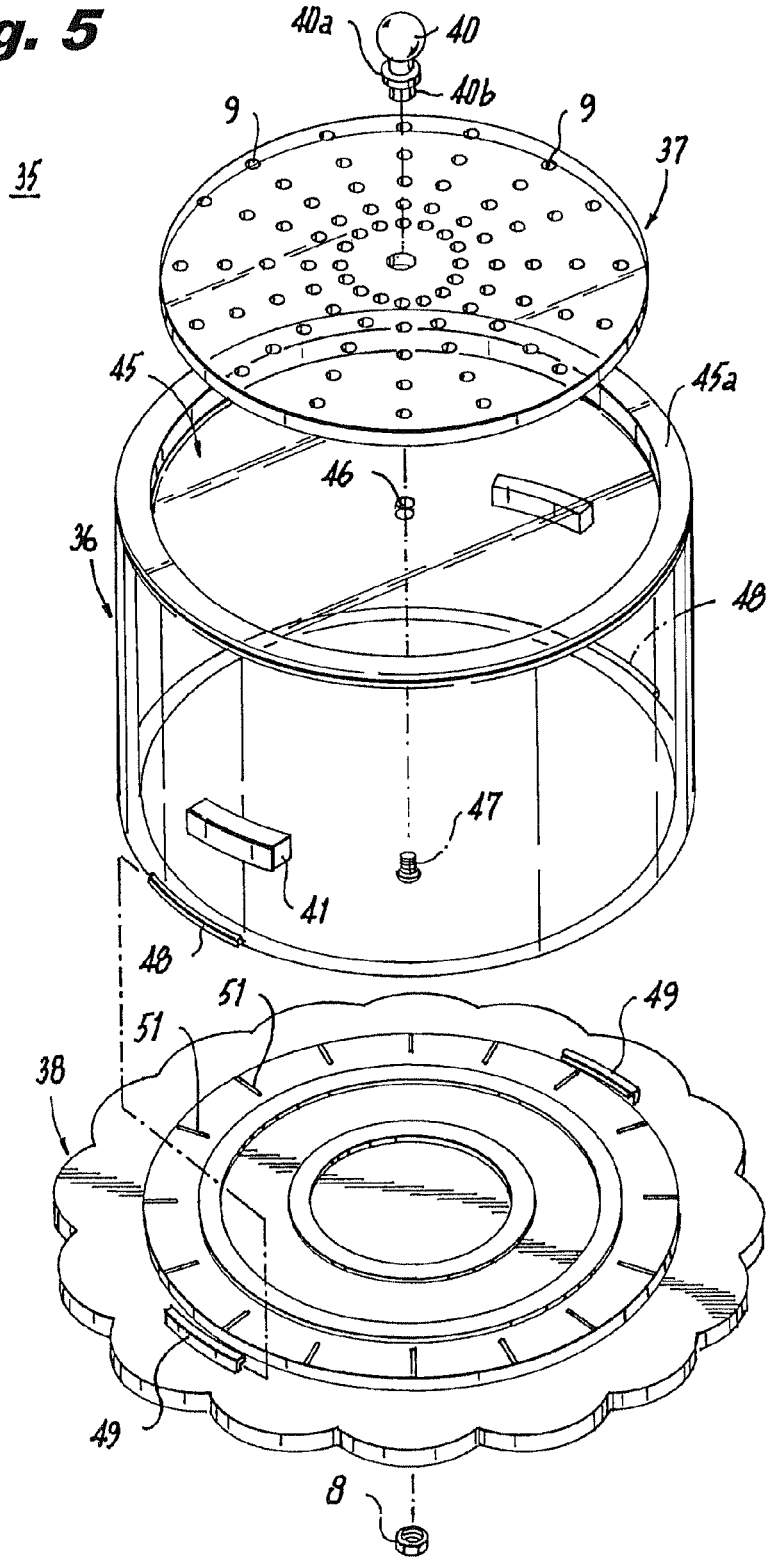
FIG. 5 is an exploded perspective view of the sanitary cover of FIG. 4 more clearly showing the base indicia to guide slice cutting.

In contrast to FIGS. 1 and 2, where the fasteners for knob 5 has threaded stem 5*b* extending below flange 5*a*, through candle deck 3 and hole 7 of cover 2, in the exploded view of FIG. 5, a fastener, such as screw 47, enters through the bottom of central hole 46 in recessed region 45 of cover 36, with peripheral ridge 45*a*, to attach candle deck 37 via the threaded hole in the bottom stem 40*b* of knob 40, above flange 40*a*. Also shown in FIG. 5, optional external protrusion 48 of transparent cover 36 enters recess 49 on base 38, to lock transparent cake cover 36 to platform base 38. Optional indicia 51 are guides for cutting uniform cake slices.

FIG. 6 shows transparent sanitary cover 36 to house fruit 53. It is noted that knob 40 used without candle deck 37, which has been removed.

FIG. 7 shows crossection the detail at the edge of the top peripheral ridge 45*a* of cover 36, with candle deck 37.

FIG. 8 shows a detail view of the engagement of lock housing 49 on base 38 and protrusion 48 extending from cover 36, by rotating cover 36 relative to base 38, so that protrusion 48 of sanitary cover 36 rests within the confines of lock housing 49, such as, for example, below a ledge of lock housing 49.

FIG. 9 illustrates cutting uniform slices of cheesecake 56 by aligning knife 57 with indicia marks 51 which extend beyond the circumference of cake 56.

FIG. 10 shows the underside of platform base 38 with short legs 61 and a fastener, such as central screw stud 60, which secures candle deck 37 for storage of candle deck 37 under base 38, via a further complementary fastener, such as nut 8.

Figure 11:
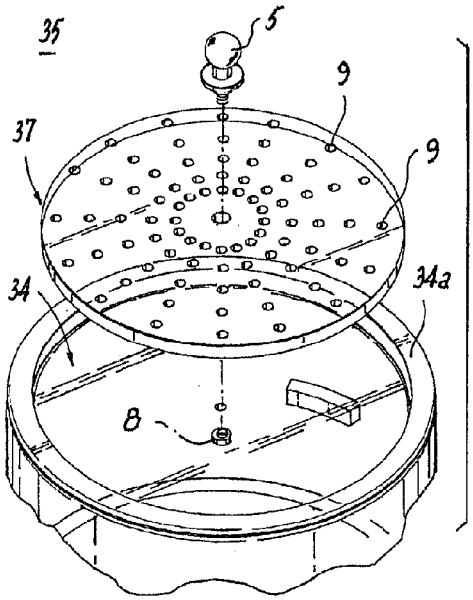
FIG. 11 is a top perspective detail showing a different knob used to attach the candle deck of FIG. 4.

FIG. 11 is a detail view of transparent sanitary cover assembly 35 having transparent cover 36 with peripheral upper ridge 34*a*, and depressed recess 34, using knob 5 to secure removable candle deck 37 via nut 8.

Figure 11A:
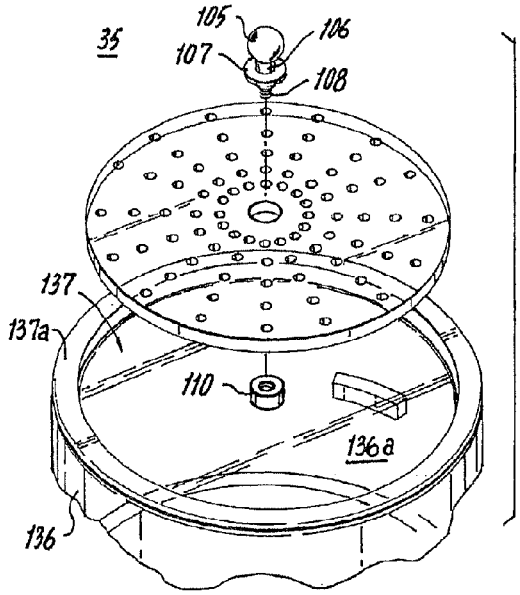
FIG. 11A is a top perspective detail showing a threaded stem knob engageable with an upwardly extending threaded boss, integrally formed with the top of the cover.

FIG. 11A shows an alternate embodiment where knob 105 has a finial or other grasping portion 105, having a stem 106, supporting a circumferential flange collar 107 above a threaded member 108, which engages a threaded upwardly extending boss 110 formed integrally with the top 136*a* of cover 136. Cover 136 has depressed recess 137 formed between the confines of upwardly extending peripheral edge rim 137*a* extending along a top peripheral edge of cover 136.

While FIG. 11A shows exterior threads on threaded stem 108 insertable within the internally threaded boss 110, it is also known that the opposite configuration can be used, where a stem on knob 105 has interior threads and the boss has exterior threads engageable therewith (not shown).

Figure 12:
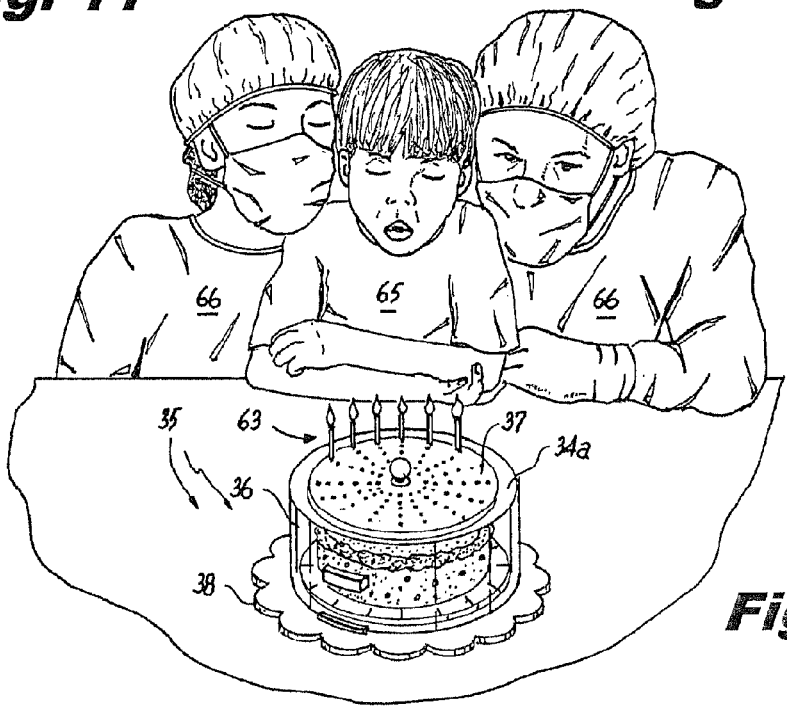
FIG. 12 is a perspective view of a child flanked by two healthcare providers blowing out candles on a cake enclosed in a cake cover of this invention, possibly in a hospital environment.

FIG. 12 illustrates a possible vignette for a sanitary cake cover assembly 35 with three human figures and a transparent sanitary cover protected cake with several lighted candles 63 on candle deck 37. The child 65 may have a transmitted disease, since he or she is flanked by two healthcare providers 66 wearing face masks. Child 65 can still safely blow out the candles. After the candle deck 37 is removed and the surface of transparent sanitary cover 36 is thoroughly disinfected, transparent sanitary cover 36 can be opened, revealing a protected cake.

Figure 13A:
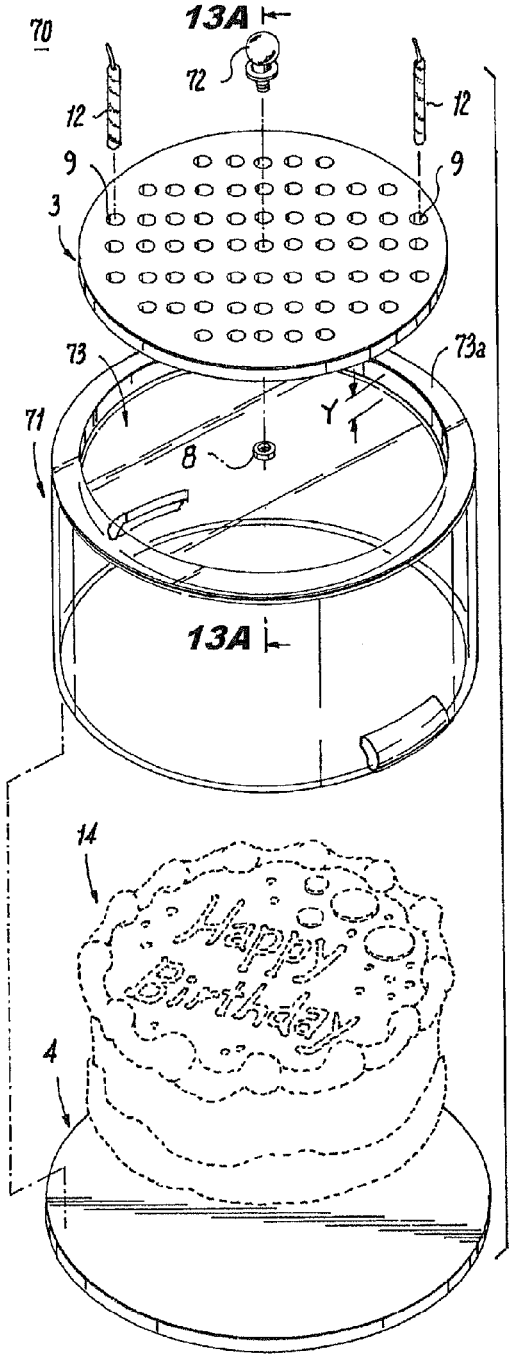
FIG. 13A is a central side detail cross section of the cake cover of FIG. 13 taken along view line 13A-13A of FIG. 13, showing the candle deck separated from the cover top by the thickness of a nut.
Figure 13:
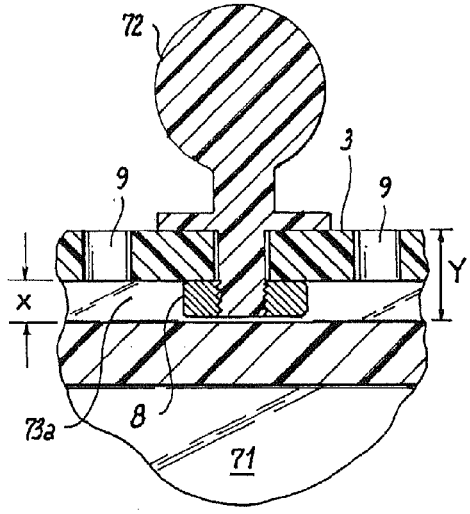
FIG. 13 is an exploded perspective view of a fifth embodiment for a cake cover wherein the candle deck is not attached to the cover but is nestled inside the top depressed area, wherein the peripheral edge ridge is deeper than the previous embodiments to accommodate the thickness of a fastener, such as an attachment nut.

Sanitary cover assembly 70, as shown in FIG. 13, shows an alternate embodiment for one variation with removable candle deck 3 unattached to transparent cover 71, where candle deck 3 nestles on top of depressed region 73 within a high edge ridge 73*a*. Note height of edge ridge 73*a* is "Y" as indicated.

FIG. 13A is a central side cross section detail through knob 72, showing removable candle deck 3, and recessed region 73*a*. It shows that knob 72 has a short threaded extension that is as long as nut 8 is thick, which is just slightly less than gap "X" as indicated. The total height of deck thickness plus gap "X" is equal to "Y", the height of ridge 73*a*. Note that recessed region 73 does not have a central hole. The draft angle of the edge ridge around deck 3 is an interference fit which keeps candle deck 3 level within gap "X". Therefore, candle deck 3 is not connected by a fastener to transparent cake cover 71, and is held in place by gravity within the recess 73, formed by the upwardly extending peripheral top ridge 73*a* of cover 71.

Figure 13B:
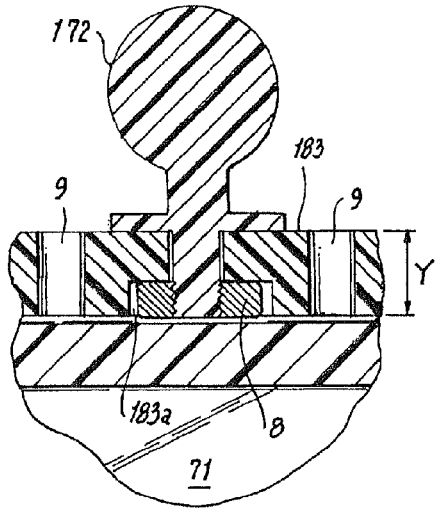
FIG. 13B is an alternate embodiment for a central side detail cross section of the cake cover of FIG. 13 showing the candle deck resting on the top of the cover, where the candle deck has a lower counter sink region to accommodate the thickness of a nut, therein.

FIG. 13B shows an alternate embodiment detail in crossection through knob 172, showing removable candle deck 183 with candle holes 9, and cover 71 having recessed region 73 and raised peripheral ridge 73*a* of FIG. 13. Knob 172 has a short threaded extension that is engageable with a nut 8, but where candle deck 183 has a countersink region 183*a* to accommodate nut 8, so that nut 8 does not extend below the bottom of candle deck 183, which sits in recess 73 upon the top of cover 71, which therefore has no holes in it, and is smooth all along its top surface edge between the confines of ridge 73*a*.

Figure 14:
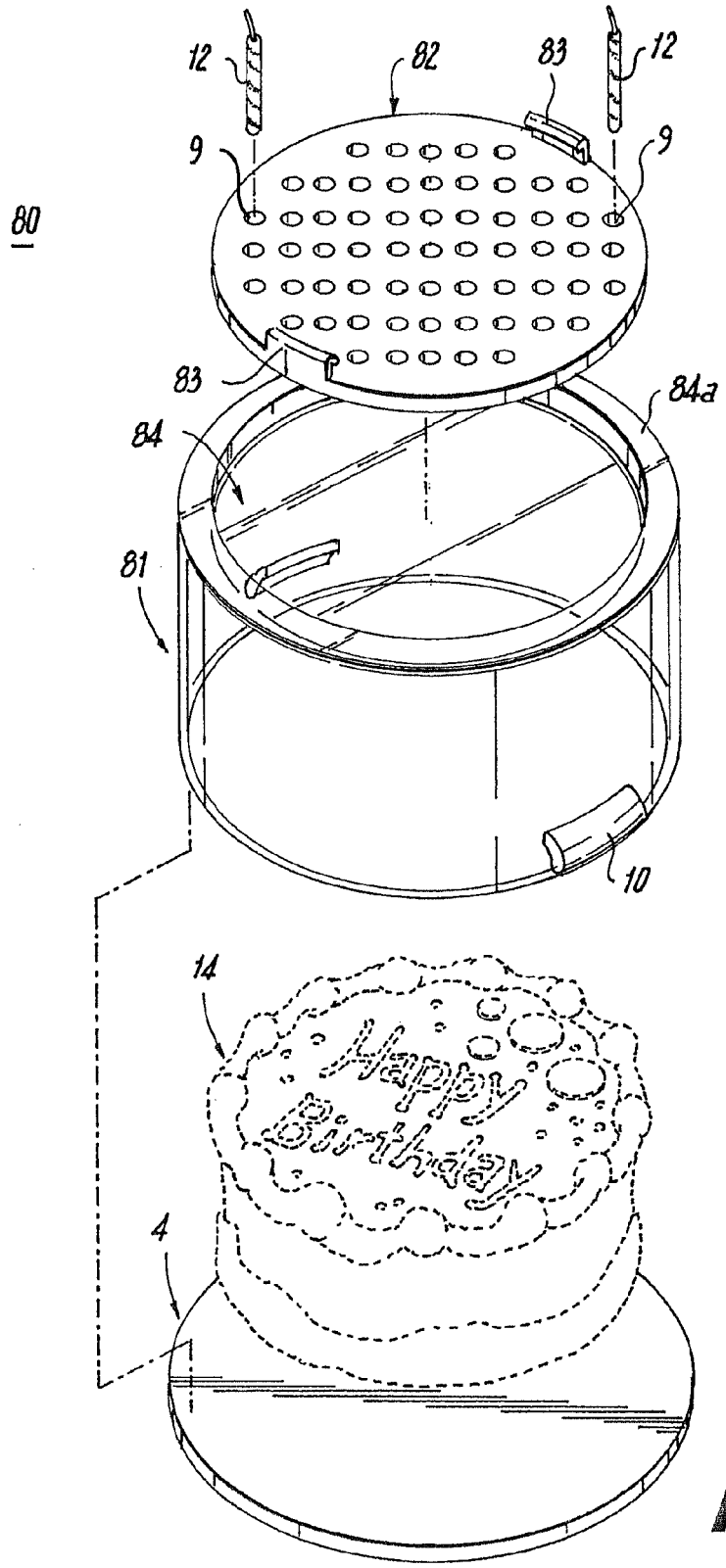
FIG. 14 is an exploded perspective view of a sixth embodiment for an alternate type of candle deck that is not attached to the cover wherein; it has recessed side handles instead of a central knob.

FIG. 14 shows a different variation of sanitary cover 80 assembly, also with an unattached removal candle deck 82, which has recessed handles 83 at the edge for lifting, and no central knob is used. Here again, recessed region 84 (which can have a recessed ridge 84*a* of less height than in FIG. 13) does not have a central hole. Candle deck 82 just rests atop recessed region 84 at the top of cover 81 when in use. The recess 84 diameter and ridge height are less critical in this variation.

While the aforementioned shows preferred embodiments, it is noted that other embodiments may be contemplated, as noted in the appended claims.

For example, in the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A sanitary cake cover dual use assembly comprising:

a protective transparent cover for a cake comprising a side wall and a top having a raised peripheral edge surrounding an area forming a depression in said top of said cover fully enclosing said cake, said transparent cover adapted to be impervious to assault by normal airborne contaminants, such as dust and dirt as well as that from contaminated microbe infiltrated, expelled breath during the act of blowing out candles;

a platform base supporting said cake within said cover, a removable candle deck within said top depressed area of said cover having an array of holes for insertion of candles therein; wherein said platform base has a plurality of support legs providing a hollow space under said platform base for storage of said candle deck when not in use, said platform base having a screw extending down therefrom for securing said candle deck to an under side of said base platform and having a further complementary fastener for engagement with said screw stud; and a knob having a screw extension extending through a central opening in said candle deck and depressed area threadably engaged with a nut mounted on the underside of said depressed area of said cover for lifting said cover with candle deck.

2. The sanitary cake cover assembly as in claim 1 wherein said transparent cover includes engagement members mating with, and locking, said transparent cover to said platform base.

3. The sanitary cake cover assembly as in claim 2 further comprising said platform base extending beyond the circumference of a cake, said platform base having indicia as a guide to cutting standard sized slices of the cake.

4. The sanitary cake cover assembly as in claim 3 wherein said transparent cover is round.

5. The sanitary cake cover assembly as in claim 3 wherein said transparent cover is rectangular.

6. The sanitary cake cover assembly as in claim 3 wherein said transparent cover has a fanciful shape corresponding to a fanciful shape of a cake.

7. The sanitary cake cover assembly as in claim 3 wherein said lock engagement members of said cover comprise a protrusion extending from said transparent cover and a lock housing, wherein, by rotating said cover relative to said platform base, said protrusion rests within the confines of said lock housing.

8. The sanitary cake cover as in claim 1 wherein said candle holes penetrate through said candle deck.

9. The sanitary cake cover as in claim 1 wherein said candle holes partially penetrate said candle deck.

* * * * *